US008011998B2

(12) United States Patent
Lamarche

(10) Patent No.: US 8,011,998 B2
(45) Date of Patent: Sep. 6, 2011

(54) EXPANSIBLE SANDING BLOCK EXHIBITING OBLIQUE EXTENDING SURFACES

(76) Inventor: Paul Lamarche, Rochester Hills, MI (US)

( * ) Notice: Subject to any disclaimer, the term of this patent is extended or adjusted under 35 U.S.C. 154(b) by 1143 days.

(21) Appl. No.: 11/734,614

(22) Filed: Apr. 12, 2007

(65) Prior Publication Data

US 2008/0254723 A1 Oct. 16, 2008

(51) Int. Cl.
*B24D 17/00* (2006.01)

(52) U.S. Cl. ..... 451/495; 451/456; 451/504; 451/513; 451/514; 451/517; 451/523

(58) Field of Classification Search ..... 451/495, 451/456, 504, 513, 514, 517, 523, 524, 512
See application file for complete search history.

(56) References Cited

U.S. PATENT DOCUMENTS

| | | | | | |
|---|---|---|---|---|---|
| 1,947,054 | A | * | 2/1934 | McReynolds | 451/492 |
| 2,457,045 | A | * | 12/1948 | Kitterman | 451/502 |
| 2,761,257 | A | * | 9/1956 | Mendelsohn | 451/504 |
| 3,106,806 | A | | 10/1963 | Hutchins | |
| 3,429,078 | A | * | 2/1969 | Beckering | 451/297 |
| 3,601,933 | A | * | 8/1971 | Bowen | 451/504 |
| 3,699,729 | A | | 10/1972 | Garvey et al. | |
| 4,062,152 | A | | 12/1977 | Mehrer | |
| 4,242,843 | A | * | 1/1981 | Phillips | 451/512 |
| 4,334,390 | A | * | 6/1982 | Sumerau | 451/355 |
| 4,478,011 | A | * | 10/1984 | Russell | 451/492 |
| 4,525,959 | A | * | 7/1985 | Ziebarth et al. | 451/512 |
| 4,680,895 | A | | 7/1987 | Roestenberg | |
| 4,688,356 | A | | 8/1987 | Madzgalla et al. | |
| 4,694,616 | A | * | 9/1987 | Lindberg | 451/355 |
| 4,730,430 | A | * | 3/1988 | Petrovich | 451/519 |
| 5,172,524 | A | * | 12/1992 | Poss | 451/504 |
| 5,283,988 | A | | 2/1994 | Brown et al. | |
| 5,383,308 | A | * | 1/1995 | Beloff et al. | 451/519 |
| 5,387,251 | A | * | 2/1995 | Rouse | 451/513 |
| 5,474,490 | A | | 12/1995 | Allport | |
| 5,605,500 | A | | 2/1997 | Matechuk et al. | |
| 5,720,654 | A | * | 2/1998 | Mac Donald | 451/523 |
| 6,053,805 | A | | 4/2000 | Sanchez | |
| 6,196,909 | B1 | * | 3/2001 | Cadrobbi | 451/499 |
| 6,213,857 | B1 | * | 4/2001 | Duquette | 451/513 |
| 6,419,569 | B1 | * | 7/2002 | Frech et al. | 451/355 |
| 6,663,479 | B2 | * | 12/2003 | Sendelbeck | 451/523 |
| 6,682,400 | B2 | | 1/2004 | Draper | |

(Continued)

FOREIGN PATENT DOCUMENTS

JP 01-129068 9/1989

*Primary Examiner* — Eileen P. Morgan
(74) *Attorney, Agent, or Firm* — Gifford, Krass, Sprinkle, Anderson & Citkowski, P.C.

(57) ABSTRACT

A sanding block for supporting an exteriorly mounted looped sanding belt having an elongated and planar shaped base. A planar shaped cover exhibits first and second oblique extending surfaces and, upon engaging with the base by a plurality of mating tabs and slots, collectively defines a three-dimensional article for supporting thereupon the looped sanding belt. A trigger exhibits a three-dimensional rectangular shape and extends laterally across a widthwise defined opening in the base in communicating fashion with an end surface associated with the cover, such that the trigger is positioned between the base and cover. The trigger is displaced in a first lateral direction to lengthwise displace the cover away from the base, the trigger displacing in a second and opposite lateral direction to reverse displace the cover inwardly towards the base.

17 Claims, 4 Drawing Sheets

U.S. PATENT DOCUMENTS

| | | | | |
|---|---|---|---|---|
| 6,755,727 | B1 * | 6/2004 | Bjerkhoel | 451/513 |
| 6,835,124 | B2 | 12/2004 | Stephan | |
| 7,018,280 | B2 * | 3/2006 | Walker | 451/355 |
| 7,025,667 | B1 * | 4/2006 | LaMarche | 451/523 |
| 7,419,423 | B1 * | 9/2008 | Reeves, Sr. | 451/523 |
| 2001/0007813 | A1 * | 7/2001 | Cadrobbi | 451/526 |
| 2002/0111127 | A1 | 8/2002 | Tseng | |
| 2004/0152405 | A1 | 8/2004 | Stephan | |
| 2005/0079810 | A1 * | 4/2005 | Melvin et al. | 451/360 |
| 2005/0272356 | A1 * | 12/2005 | Walker et al. | 451/355 |
| 2005/0272357 | A1 * | 12/2005 | Walker | 451/355 |
| 2006/0264161 | A1 * | 11/2006 | Schnell et al. | 451/355 |

* cited by examiner 18
27
26, 28
60
42
58
41
40

52
4
36
50

30
22

EXPANSIBLE SANDING BLOCK EXHIBITING OBLIQUE EXTENDING SURFACES

FIELD OF THE INVENTION

The present invention relates generally to a hand-held sanding block design. More specifically, the present invention teaches an improved sanding block design exhibiting oblique extending surfaces. The sanding block incorporates a two-piece construction capable of being axially expanded or contracted, by virtue of a laterally displaceable trigger, and in order to selectively tension or loosen the oblique block surfaces relative to an outer positioned sanding belt.

DESCRIPTION OF THE PRIOR ART

The prior art is well documented with various examples of hand-held sanding block designs. The objective of such sanding blocks is the ability to selectively grip or loosen an exteriorly mounted sanding belt for any desired sanding application associated with wood, plastics, gypsum board and the like A first example of a sanding block drawn from the prior art is set forth in U.S. Pat. No. 6,196,909, issued to Cadrobbi, and which teaches an abrading tool exhibiting an abrasive belt loosely wrapped about an elongated block. A tension adjuster is inserted between the belt and the block, the belt tension being adjusted by sliding the tension adjuster lengthwise either towards or away from the end of the block. An alternate variant includes a lengthwise extending slot defined in a base block, and within which is secured a mounting block to secure the abrasive sheet to the base block.

U.S. Pat. No. 5,387,251, issued to Rouse, teaches an endless belt sanding block, exhibiting four flat rigid support sections connected by a set of hinges in order to form a closed loop. First and second tapered supports are folded inwardly at the junction of their thickened ends, and in order to contract the assembly to permit the installation or removal of an overlaying sanding belt. A brace section is located inside the foldable loop and connects to the same hinge and in order to form a triple hinge to maintain the endless sanding belt taut and ready for use.

U.S. Pat. No. 5,720,654, issued to Mac Donald, teaches a hand sanding block for use with an endless abrasive belt of the type normally used with power sanders. The block exhibits a body and a slidable nose which is biased outwardly. A pin limits the outward travel of the nose relative to the body. A detent is provided so that nose may be temporarily secured in a retracted position for ease of loading and unloading sanding belts.

SUMMARY OF THE INVENTION

The present invention discloses a novel and improved sanding block incorporating first and second assembleable halves defining multiple and oblique extending surfaces. Typically, a base component exhibits a planar shape and to which is slidably interengaged a cover exhibiting first and second oblique surfaces. Mating tabs and slots defined along engaging surfaces of the components define a degree of travel therebetween and which facilitate either outward extension or inward collapsing in order to install and tauten or to remove an endless (looped) sanding sheet, such as typically associated with a wallboard or wood sanding operation.

A trigger component exhibits a substantially elongated and three-dimensional configuration and extends between abutting locations defined between the base and cover. The trigger includes an elongate aperture defined along a side surface and within which is defined a ramped surface. A fixed and inward directed end projection associated with the base travels along the ramped surface, during lateral translation of the trigger, this in turn causing the trigger and slidably engaged cover to lengthwise translate in the selected displacing direction.

A recess extends along a top surface of the trigger parallel to the side surface aperture, a downward guide projection associated with the cover seating within the top recess. A detent is formed in an intermediate location of the recess, contacting the downward guide projection to indicate a fully expanded position associated with the article.

Other features associated with the present design include the exterior surfaces associated with the base and cover further exhibiting projecting scales, between which are defined vacuum withdrawal passageways communicating with the interior of the three-dimensional article via slots defined in the exterior surfaces. A vacuum attachment aperture defined in a side surface associated with the cover facilitates retrieval of accumulated particles resulting from a sanding operation.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Referring now to each of FIGS. 1-5, a sanding block article is illustrated at 10 according to a preferred embodiment of the present invention. As described previously, the present invention is an improvement over prior art sanding block designs, in that it provides a multi (oblique) surface article, trigger actuated, device which is capable of being quickly extended/retracted in order to install or replace a sanding belt for a desired sanding operation. As will also be described in greater detail, the sanding block construction incorporates a number of aperture inlets and which, in cooperation with a vacuum attachment (see at 12 in FIG. 1), provide for vacuum removal of particles resulting from the sanding operation.

Figure 2:
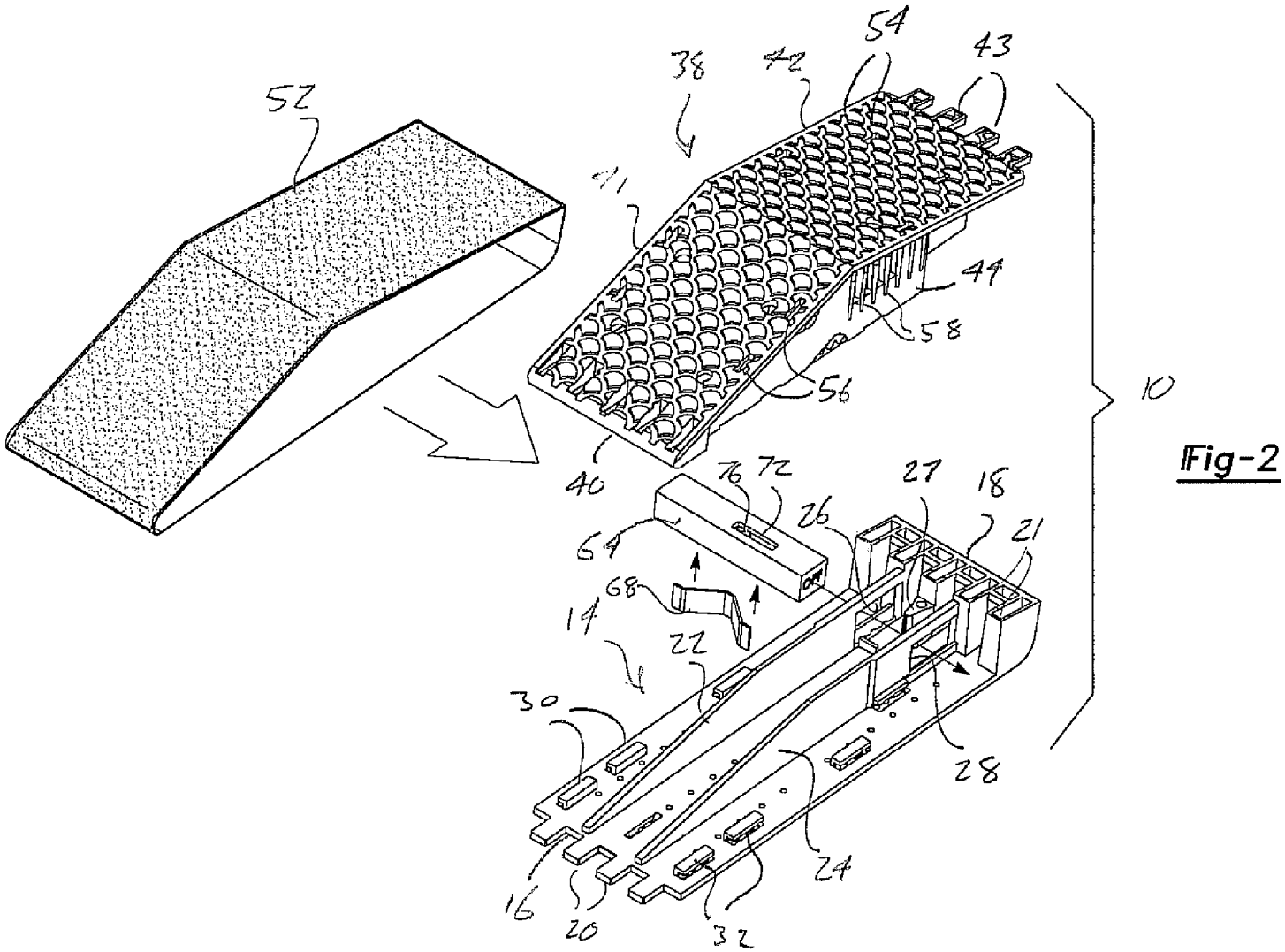
FIG. 2 is a first exploded illustration of the sanding block showing the interengageable base and cover components defining the adhering surfaces for the endless sanding belt, as well as the laterally traversable trigger for selectively outwardly or inwardly displacing the components to selectively loosen or tauten the belt.

Referencing again the exploded perspective views of FIG. 2 (upper) and 5 (rotated lower), a substantially elongated and planar shaped base is illustrated at 14 and includes a first end 16 and a second three-dimensional rounded end 18. The base 14 is constructed of a durable plasticized material and includes, at its first end 16, a plurality of laterally extending and spaced apart guides, see further at 20, as well as corresponding opposite end and spaced apart guides 21 associated with its opposite and rounded end 18.

As is further shown in the inverted exploded perspective of FIG. 2, a pair of depthwise extending support ribs 22 and 24 extend in arcuate fashion from first end 16 and terminate at the rounded second end 18. Defined in the support ribs 22 and 24 are rectangular and depthwise extending openings, see inner rectangular walls 26 and 28, these creating a laterally extending aperture through the base interior. A fixed and inward directed end projection (see as generally shown at 27 in FIG. 2) is integrally formed proximate the rounded end 18 of the base 14 and is equidistantly spaced between the rectangular defined openings 26 and 28.

Other features associated with the base 14 include a plurality of lengthwise extending tabs 30 and 32 (see FIG. 2), these projecting in outwardly facing and outboard directions relative to the support ribs 22 and 24, and at lengthwise spaced locations along the inner face of the base 14. An opposite exterior defined face of the base 14 exhibits a plurality of textured or projecting scales, see at 34 in FIG. 5, between which are defined vacuum withdrawal passageways 36 communicating with the interior side of the base.

Figure 5:
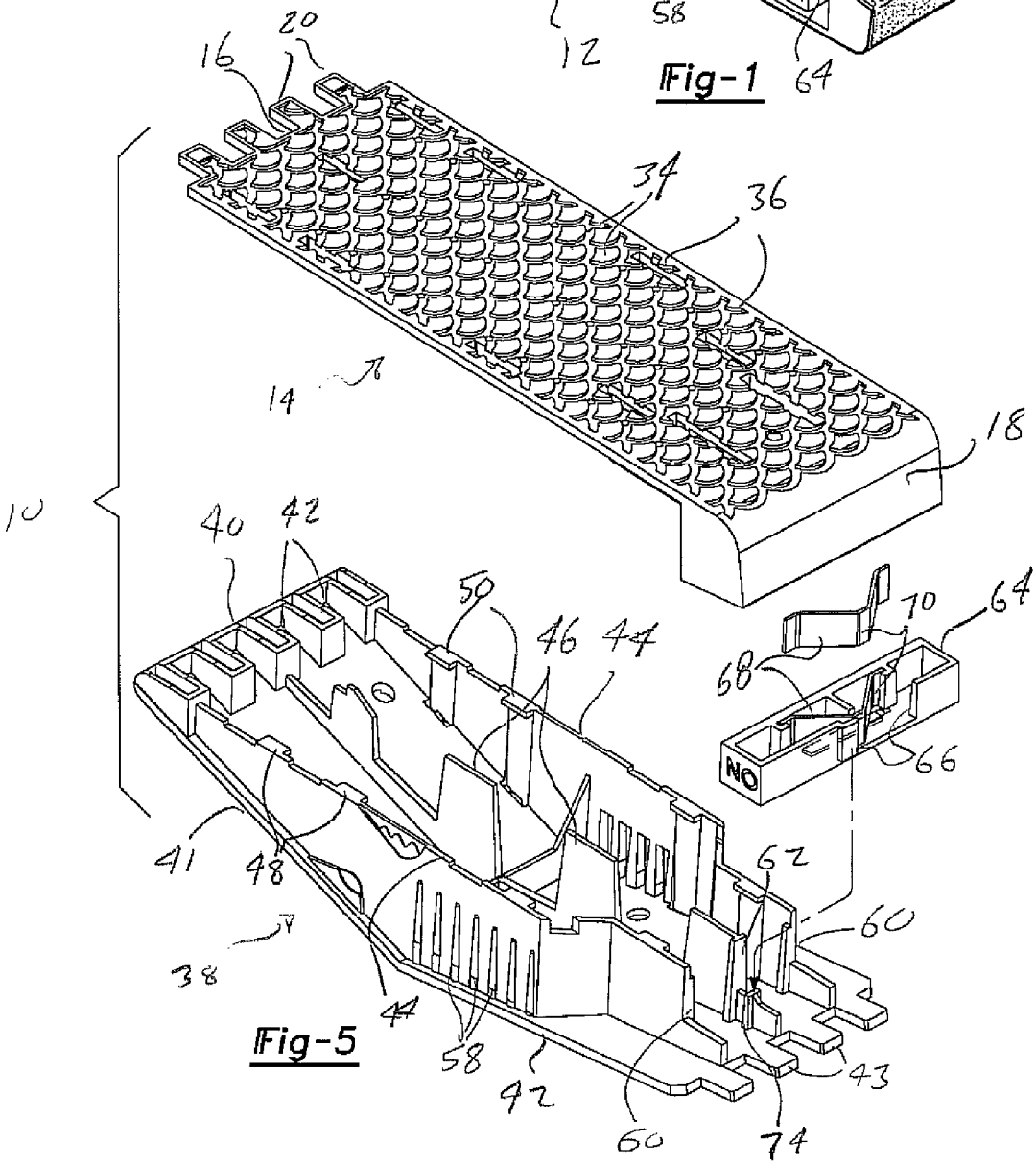
FIG. 5 is a further exploded illustration of the sanding block components, inverted in comparison to that shown in FIG. 2, and showing the scaled exterior nature of the base component in corresponding fashion to that exhibited by the cover exterior in FIG. 2.

Also illustrated in the exploded view of FIG. 5 is the arrangement of elongated apertures 36 extending through the thickness of the base 14, these typically corresponding to the placement and location of the reverse side projecting tabs 30 and 32 and resulting from material reshaped from the base during a suitable plastic forming process for creating the base. As will be described in additional detail, one feature of the sanding block is the ability to facilitate vacuum withdrawal and removal of sanding particles through an interior of the block and for removal through the engaged vacuum attachment 12.

Referring again to the various illustrations, and in particular to FIGS. 2 and 5, a substantially elongated and planar shaped cover 38 exhibits first and second oblique extending surfaces 41 and 42. The cover 38 is, similar to the base 14, constructed of a durable plasticized material and includes, at its first end 40, a plurality of laterally extending and spaced apart guides, see further at 42 in FIG. 5. Located along an opposite second end of the cover are spaced apart guides 43, these similar to those shown at 20 in reference to the base.

As is further shown in the inverted exploded perspective of FIG. 5, a pair of outer and depthwise extending support walls 44 are provided, between which an inner support rib 46 extends lengthwise along the interior of the cover 38, in spaced apart and overlapping fashion relative to the support ribs 22 and 24 associated with the base 14. The cover 38, as with the base 14, further includes interengaging surfaces, upon which are defined a plurality of tabs 48 and 50 (see again FIG. 5).

Figure 1:
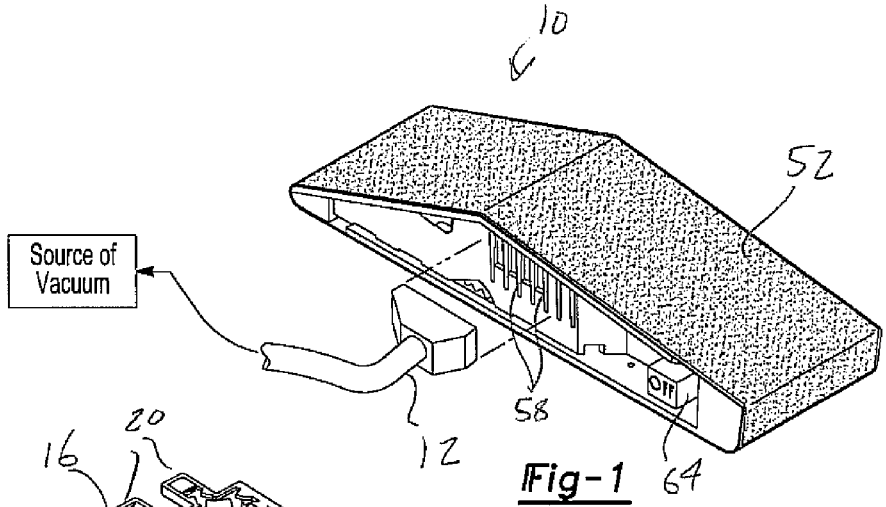
FIG. 1 is an environmental perspective illustration of the sanding block design and showing, in partially exploded fashion, a vacuum hose attachment.

Upon engagement with mating tabs 30 and 32 associated with the base, the tabs 48 and 50 assemble in a lengthwise traversable fashion in order that the base and cover collectively define a three-dimensional article for supporting thereupon a looped sanding belt 52 (see again FIG. 1). Reference is also made to the crosswise cutaway illustration of FIG. 4, and which shows the nature in which the lengthwise traversable and sliding connection is established between the interengaging and mating tabs associated with the cover and base.

An opposite exterior defined face of the cover 38 exhibits a plurality of textured or projecting scales, see at 54 in FIG. 2, between which are defined vacuum withdrawal passageways. These communicate with interior leading apertures 56 and which, similar to those identified in reference to the base, communicate the exterior surfaces of the assembled article with its interior. Also defined in selected outer support wall 44 of the three-dimensionally defined cover 38 are a plurality of spaced side openings 58, these collectively defining a connecting port to which is secured the vacuum attachment 12.

Of note, the outer walls 44 of the cover substantially terminate at stepped locations, see at 60, in proximity to its end 43 and in substantial alignment with the windowed apertures 26 and 28 established in the base interior. A stepped end 62 of the interior rib 46 (see again FIG. 5) corresponds in placement and location to the outer stepped outer ends 60.

A trigger 64 exhibits a substantially three-dimensional rectangular shape, also typically constructed of a durable plasticized material, and extends laterally across the windowed (26 and 28) widthwise defined opening in the base 14 in communicating fashion with associated end surface 43 of the cover 38. The trigger 64 is thus positioned between the base and cover during assembly of the components 14 and 38, as best referenced in the succeeding illustrations of FIGS. 3A and 3B. In this manner, the base and cover are positioned for slidable engagement by virtue of their opposite engageable guide portions (20 and 43) being received in their respective and associated end receiving locations 18 and 40, concurrent with the mating and slot defining tabs between the components being achieved and as is again shown by FIG. 4.

The trigger 64 exhibits an elongate aperture defined along a side surface, see as shown by inwardly defined walls 66 in FIG. 5. A ramped surface is established within the interior of the trigger 64 and, in the illustrated embodiment, is provided by a substantially flattened "V" shaped clip portion 68 which is secured in inserting fashion within an open bottom face of the trigger, further such that an apex point 70 of the ramped surface (clip 68) is located proximate an edge defining surface of the side aperture 66.

Figures 3A, 3B, 3C, 4:
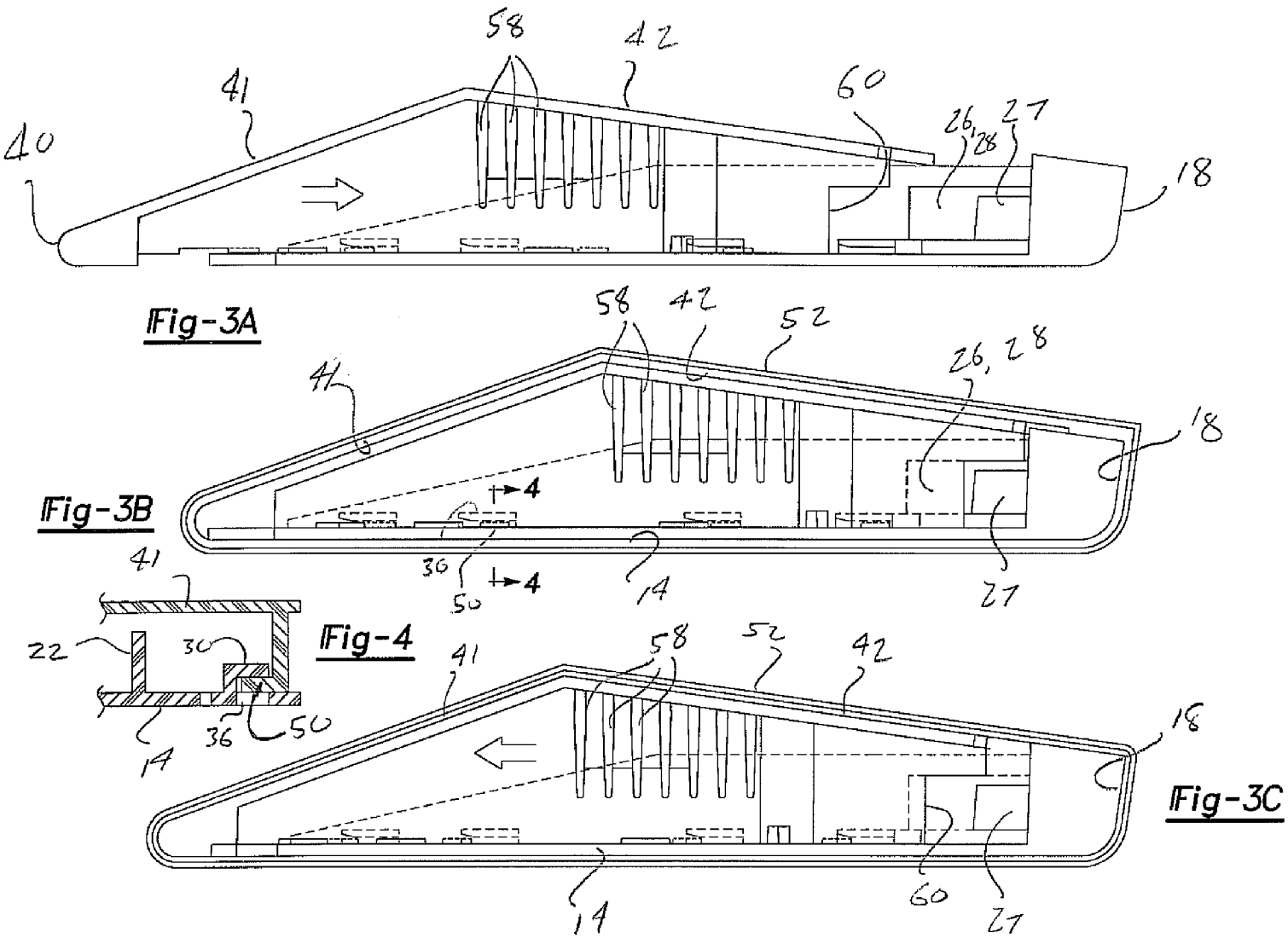
FIG. 3A is a first side plan view of an installation of a cover to a base component of the sanding block
FIG. 3B is a succeeding plan view to that shown in FIG. 3A and by which the base and cover components are engaged with the laterally displaceable trigger arranged therebetween.
FIG. 3C is a further succeeding side plan view of the sanding block in a linearly expanded position.
FIG. 4 is a cutaway view taken along line 4-4 of FIG. 3 and illustrating an exemplary connection between aligning tabs associated with the base and cover components.

The trigger further includes a recess 72 extending along a top surface parallel to the side surface aperture 66 (see FIG. 2), a downward/inward guide projection 74 (see exploded view of FIG. 5) associated with the cover 38 seating within the top recess 72 upon assembly of the cover and base components about the trigger as referenced in FIGS. 3A-3C.

Upon assembly, the fixed and inward directed end projection 27, associated with the base 14, travels along the ramped surface defined by the clip portion 68 and, during lateral translation of the trigger 64 through the windows 26 and 28 and from one side to the other, causes the trigger and slidably engaged cover to lengthwise translate in a selected inward or outward displacing direction. An example of the outward sliding displacement caused by this arrangement of geometry is set forth again in the illustration of FIG. 3C and whereby the trigger 64 and cover 38 are displaced outwardly in the general direction of the reference arrow associated with that figure.

In this fashion, the trigger is displaced in a first lateral direction to lengthwise displace the cover away from said base, the trigger displacing in a second and opposite lateral direction to reverse displace the cover inwardly towards the base. This displacement action permits the installation and tautening or selective removal of the outer sanding belt 52 in an easy install/removal fashion.

Figure 6:
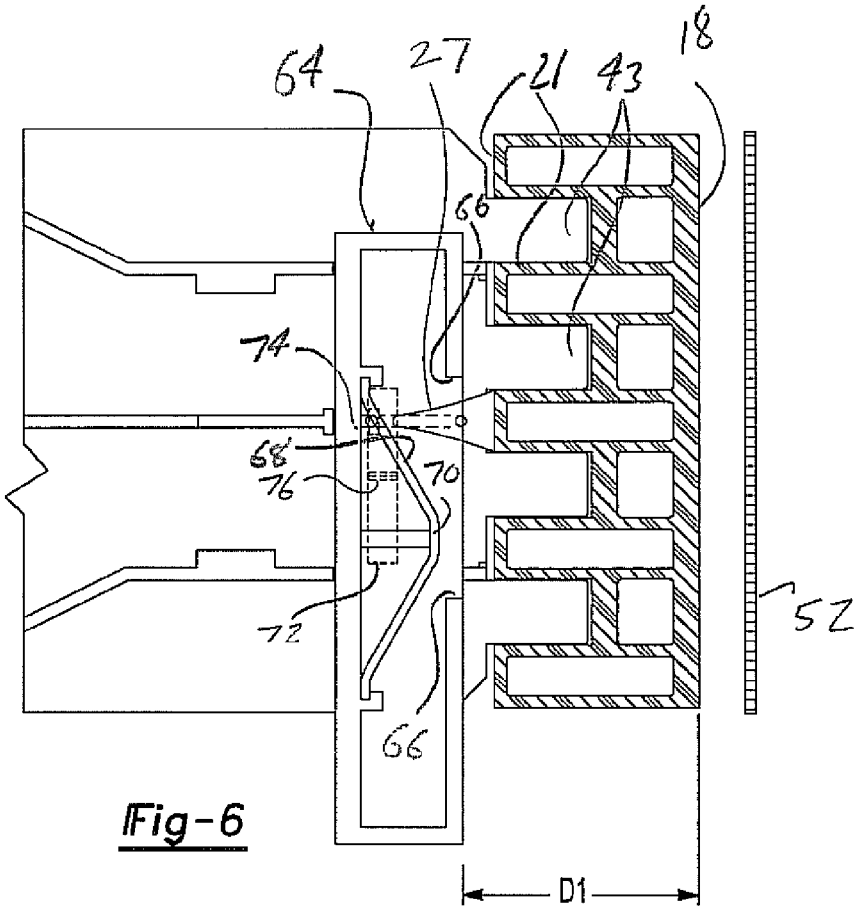
FIG. 6 is a partial cutaway view of the sanding block cover, and exhibiting the base and cover components in a first inwardly collapsed position.
Figure 7:
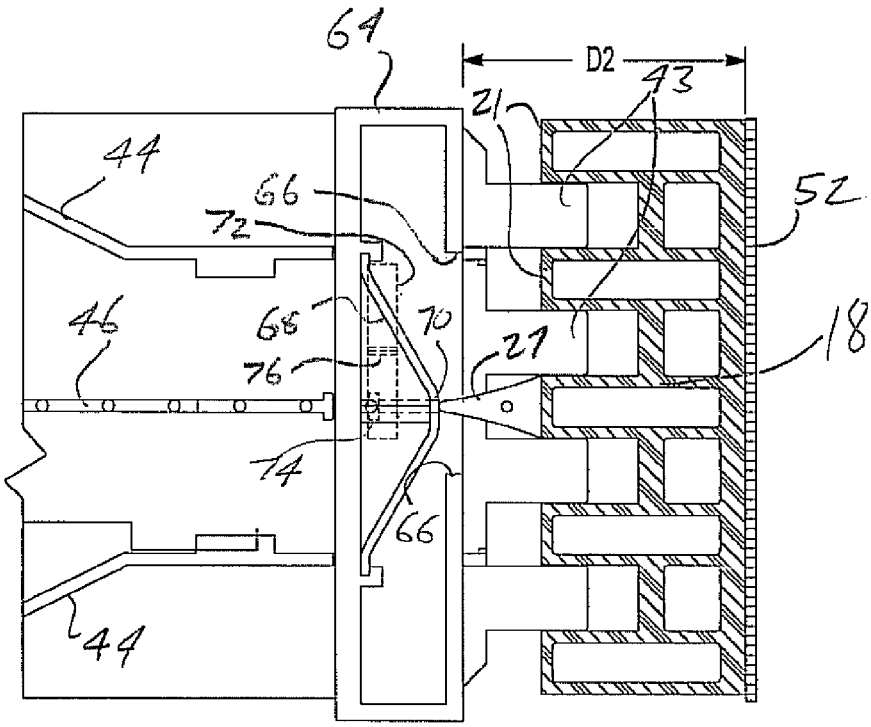
FIG. 7 is a further cutaway view illustrating outward expansion of the base and cover resulting from lateral displacement of the associated trigger.

Opposite and laterally disposed ends of the trigger 64 exhibit "ON" and "OFF" designations (see again FIGS. 2 and 5) and in order to designate the resultant action for depressing the installed trigger in either lateral direction. Reference is again made to the installed position of FIG. 3B (corresponding to sectional cutaway of FIG. 6) and outwardly displaced/belt tautened position of FIG. 3C (corresponding to sectional cutaway of FIG. 7). Respective distances D1 (FIG. 6) and D2 (FIG. 7) reference the degree of lengthwise translation associated with the trigger and cover relative to the base.

Additional features associated with the trigger 64 include the provision of a detent 76 (again FIG. 2) formed in an intermediate location of the recess 72 and which, upon assembly, contacts the downward guide projection 74 extending within the cover interior. This provides the user with a tactile indication of a fully expanded position of the cover relative to the base, and corresponds to the inwardly directed projection 27 of the base riding along the ramped surface of the clip 68 to a location proximate its apex 70.

Upon assembly, the three-dimensional defining article exhibits oblique interconnected and belt supporting surfaces (again at 14, 40 and 41) against which inner corresponding locations of the looped belt 52 are tautened in the outward displacement of FIG. 3C. In this fashion, the scaled and recess defining nature of the exterior surfaces, combined with the plurality of communicating passageways with the open interior of the article and the attachable vacuum conduit, provide for effective evacuation of wood or wallboard particles resulting from a given sanding operation. It is contemplated that the sanding block article can operate either with or without the vacuum attachment, however provision of the same provides the additional benefit of substantially dust-free sanding.

Having described my invention, other and additional preferred embodiments will become apparent to those skilled in the art to which it pertains, and without deviating from the scope of the appended claims.

I claim:

1. An expansible sanding block for supporting an exteriorly mounted looped sanding belt, comprising:

an elongate and substantially planar shaped base exhibiting a bottom extending belt supporting surface;

a cover exhibiting first and second oblique extending belt supporting surfaces establishing a peaked configuration and engageable with said base in mutually linearly extensible fashion to collectively define a three-dimensional article for supporting the sanding belt; and a trigger extending between abutting locations of said base and cover communicable with a widthwise interior passage defined in said three dimensional article, said trigger being displaced in a first lateral direction to lengthwise displace said cover in a first extensible direction relative said base and to tauten the belt, said trigger displacing in a second and opposite lateral direction to reverse displace said cover relative said base to loosen the belt, wherein said trigger exhibits a rectangular shape and further comprises an elongate aperture defined along a side surface and within the trigger is defined a ramp surface, the base having a fixed end projection that projects inwardly of said aperture, said end projection traveling along said ramped surface, during lateral translation of said trigger, causing said trigger and slidably engaged cover to lengthwise translate in the selected displacing direction.

2. The sanding block as described in claim 1, said base and cover each further comprising a plurality of lengthwise extending and mating tabs and slots defining a range of lengthwise displacement.

3. The sanding block as described in claim 2, each of said base and cover exhibiting depthwise projecting support ribs.

4. The sanding block as described in claim 2, each of said base and cover further comprising lengthwise projecting and spaced apart guides associated with said interengaging planar surfaces, opposing edges of said base and cover further comprising guide receiving recesses which, in cooperation with said mating tabs, slots and said trigger, define said range of lengthwise displacement established between said base and cover.

5. The sanding block as described in claim 3, said trigger exhibiting a substantially three-dimensional rectangular shape and extending laterally across a widthwise defined opening in said base and in communicating with an end surface associated with said cover.

6. The sanding block as described in claim 1, said trigger further comprising a recess extending along a top surface parallel to said side surface aperture, a downward guide projection associated with said cover seating within said top recess.

7. The sanding block as described in claim 6, a detent formed in an intermediate location of said recess contacting said downward guide projection to indicate a fully expanded position associated with said article.

8. The sanding block as described in claim 1, at least one of said exterior surfaces associated with said base and cover further exhibiting projecting scales, between which are defined vacuum withdrawal passageways communicating with said interior of said three-dimensional article via slots defined in said exterior surfaces.

9. The sanding block as described in claim 8, further comprising a vacuum attachment aperture defined in a side surface associated with said cover and facilitating retrieval of accumulated particles resulting from a sanding operation.

10. The sanding block as described in claim 1, said base, cover and trigger exhibiting a specified shape and size and being constructed of a durable plasticized material.

11. A sanding block for supporting an exteriorly mounted looped sanding belt, comprising:

a substantially elongated and planar shaped base having a first end and a second end and establishing a bottom extending belt supporting surface;

a substantially elongated and planar shaped cover exhibiting at least first and second oblique extending and belt supporting surfaces and having an overall length equivalent to said base, each of said base and cover further comprising interengaging surfaces upon which are defined a plurality of mating tabs and slots and by which, upon engagement, collectively define a three-dimensional article for supporting thereupon the looped sanding belt; and a trigger exhibiting a substantially three-dimensional rectangular shape and extending laterally across a widthwise defined opening in said base in communicating fashion with an end surface associated with said cover, such that said trigger is positioned between said base and cover, said trigger being displaced in a first lateral direction to lengthwise displace said cover away from said base, said trigger displacing in a second and opposite lateral direction to reverse displace said cover inwardly towards said base, wherein said trigger exhibits a rectangular shape and further comprises an elongate aperture defined along a side surface and within the trigger is defined a ramp surface, the base having a fixed end projection that projects inwardly of said aperture, said end projection traveling along said ramped surface, during lateral translation of said trigger, causing said trigger and slidably engaged cover to lengthwise translate in the selected displacing direction.

12. The sanding block as described in claim 11, said trigger further comprising a recess extending along a top surface parallel to said side surface aperture, a downward guide projection associated with said cover seating within said top recess.

13. The sanding block as described in claim 11, a detent formed in an intermediate location of said recess contacting said downward guide projection to indicate a fully expanded position associated with said article.

14. The sanding block as described in claim 11, each of said base and cover further comprising lengthwise projecting and spaced apart guides associated with said interengaging planar surfaces, opposing edges of said base and cover further comprising guide receiving recesses which, in cooperation with said mating tabs, slots and said trigger, define said range of lengthwise displacement established between said base and cover.

15. The sanding block as described in claim 11, at least one of said exterior surfaces associated with said base and cover further exhibiting projecting scales, between which are defined vacuum withdrawal passageways communicating with said interior of said three-dimensional article via slots defined in said exterior surfaces.

16. The sanding block as described in claim 15, further comprising a vacuum attachment aperture defined in a side surface associated with said cover and facilitating retrieval of accumulated particles resulting from a sanding operation.

17. The sanding block as described in claim 11, said base, cover and trigger exhibiting a specified shape and size and being constructed of a durable plasticized material.

* * * * *